United States Patent [19]

Jordaan

[11] 4,322,070

[45] Mar. 30, 1982

[54] EXERCISING APPARATUS

[76] Inventor: Gert J. Jordaan, 15 Jan Smuts Dr., Florida Park, Transvaal, South Africa

[21] Appl. No.: 162,942

[22] Filed: Jun. 25, 1980

[30] Foreign Application Priority Data

Jun. 25, 1979 [ZA] South Africa ..... 79/3163

[51] Int. Cl.[3] ..... A63B 23/04; A63B 69/16

[52] U.S. Cl. ..... 272/73

[58] Field of Search ..... 272/73; 280/293, 294, 280/295, 296, 297, 298, 299, 300, 301, 302, 303, 304; 211/17, 22

[56] References Cited

U.S. PATENT DOCUMENTS

| | | | |
|---|---|---|---|
| 1,123,490 | 1/1915 | Cooper et al. | 280/302 |
| 2,805,860 | 9/1957 | Littig | 272/73 |
| 3,735,981 | 5/1973 | Mallin | 272/73 |
| 3,866,908 | 2/1975 | Hangler | 272/73 |

FOREIGN PATENT DOCUMENTS

| | | | |
|---|---|---|---|
| 19028 | of 1894 | United Kingdom | 272/73 |

*Primary Examiner*—Richard J. Apley
*Assistant Examiner*—Arnold W. Kramer
*Attorney, Agent, or Firm*—Daley & Brandt

[57] ABSTRACT

Exercising apparatus which comprises a bicycle stably supported on a stand on a surface with the rear wheel of the bicycle free of the surface. The stand comprises a ground-engaging base, a pair of projecting rods which engage, detachably, in a pair of hollow lugs secured to the rear axle of the bicycle, a second pair of rods, one end of which is pivotally connected to the first pair of rods and the other end of which is pivotally connected to a plate which detachably engages another plate secured to the frame of the bicycle in the region of the pedals, and a roller adapted to be brought into frictional engagement with the rear wheel of the bicycle.

3 Claims, 3 Drawing Figures

FIG_1
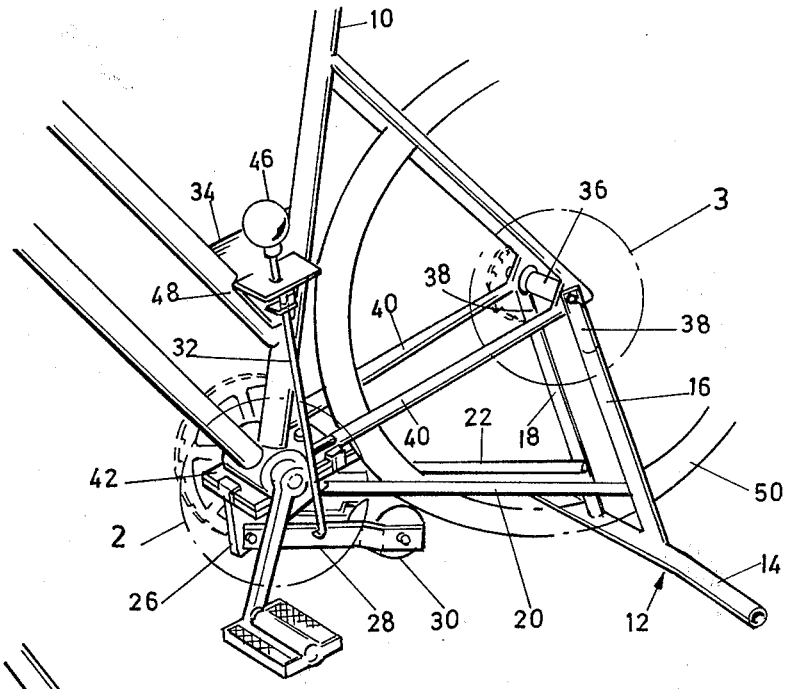
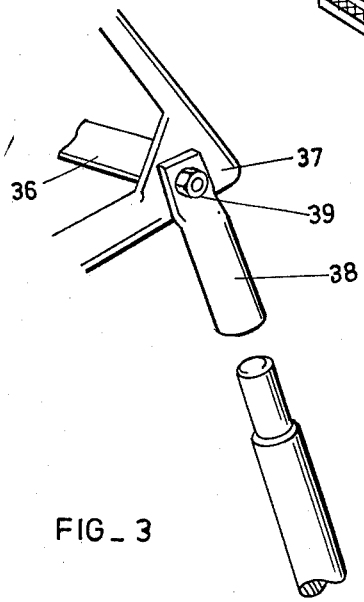
FIG_3
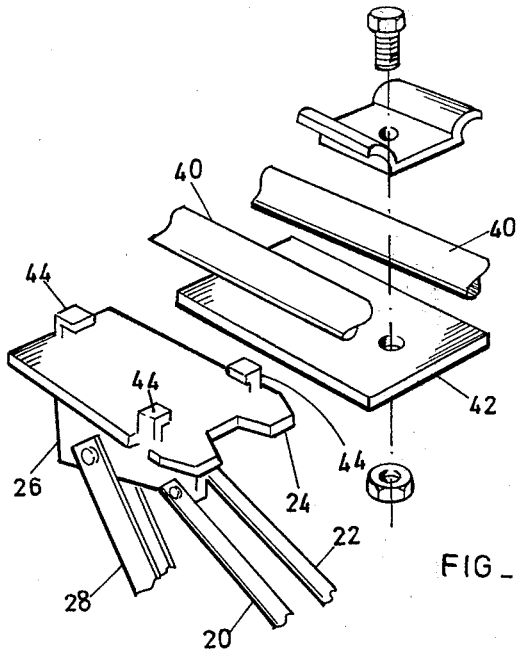
FIG_2

EXERCISING APPARATUS

This invention relates to exercising apparatus.

Exerciser cycles are well known. Such a cycle is stationarily mounted and includes a pair of pedals which are connected to an adjustable load. The person using the exerciser cycle can adjust the resistance offered by the load to the pedal action and since the cycle is stationary the user can exercise within a confined space such as a gymnasium.

An exerciser cycle works admirably but it is expensive and it may be used only in the manner described.

There have been a number of proposals for stands on which bicycles can be mounted with the rear wheel free of the ground so that the bicycle can be ridden and exercise obtained without having to travel long distances. Examples of such stands can be found described in British Pat. Nos. 521,467; 1,558,680; 2,026,876; 1,476,350 and 2,016,934. These prior art proposals, however, all suffer from one or other disadvantage. They are either too complicated or expensive to make or difficult to assemble. Many of them lack simplicity and ease of use.

According to the present invention, there is provided exercising apparatus comprising a bicycle stably supported on a stand on a surface so that the rear wheel of the bicycle is free of the surface, the stand comprising a surface-engaging base, a first pair of members, one end of which is fixed to the base to form a fixed structure, and the other end of which detachably engages with a pair of formations secured to the rear axle of the bicycle, a second pair of members, one end of which is pivotally connected to the fixed structure and the other end of which detachably engages with a formation secured to the frame of the bicycle in the region of the pedals, and a roller adapted to be brought into frictional engagement with the rear wheel of the bicycle. The stand is thus detachable from the bicycle leaving the engaging formations thereon. The stand can easily be engaged and disengaged and the bicycle therefore used either in the conventional manner or as a stationary exercising apparatus.

The formations secured to the rear axle may be hollow lugs which are preferably mounted on the axle between the frame of the bicycle and a holding nut. The holding nut may be of the conventional type.

The pairs of members will generally be rods giving the stand a framelike structure.

One end of the second pair of members may be pivotally secured to a plate which detachably engages another plate secured to the frame of the bicycle in the region of the pedals. The one plate may be provided with upstanding formations adapted to receive an edge of the other plate detachably to hold the two plates together. Thus, the one plate may be adapted to be engaged or disengaged from the other plate by sliding one plate over the other.

The roller may be adjustable relative to the wheel so that the resistance offered by the roller to the wheel can be varied. Generally, the roller will be adapted to engage the wheel on the underside thereof and the resistance offered by the roller to the wheel varied by raising or lowering the roller. The roller may be connected to a lever by means of which it can be raised or lowered.

The invention further extends to a kit for use in producing an exercising apparatus of the type described above. This kit will include a stand the type described together with a roller and appropriate formations for securing to the rear axle and the frame in the region of the pedals.

The invention is further described by way of example with reference to the accompanying drawings in which:

FIG. 1 is a view partially in perspective of portion of a bicycle fitted with a device according to the invention, FIG. 2 is an enlarged exploded view of that portion of FIG. 1 which is ringed and marked 2, and FIG. 3 is a similar view of that portion of FIG. 1 which is ringed and marked 3.

The drawings illustrate portion of a bicycle 10 supported on a stand 12.

The stand comprises a ground-engaging rod 14, two upstanding rods 16 and 18 both fixed to the rod 14 and two struts or rods 20 and 22 pivotally connected at one end to the rods 16 and 18 respectively. The other ends of the struts 20, 22 are pivotally connected to a web 26 fixed to the underside of plate 24. A support member 28 is pivotally connected to the web and carries on its free, open end a roller 30. The support member 28 is pivotally attached to lever 32 which passes through retainer plate 34.

As shown more clearly in FIG. 3, the rear axle 36 of the bicycle is fitted with two hollow lugs 38. These lugs are secured to the axle between the bicycle frame 37 and a standard holding nut 39. The lugs can easily be fitted to the bicycle and once fitted do not interfere with the normal use of the bicycle.

FIG. 2 is an enlarged view of the region of the pedal axle of the bicycle. Two frame struts 40 of the bicycle extend from the rear axle 36 to the pedal axle and form a V at the pedal axle. A plate 42 is bolted to the underside of the fork. The size of the plate 42 is such that it does not interfere with the pedal action.

The plates 24 and 42 are substantially of the same size but the former plate is formed with upstanding bent over formations 44.

The lever 32 has at its upper end an adjustment knob 46 by means of which the lever can be moved relatively to the retainer plate 34. Rotation of the knob 46 in one direction raises the lever and rotation in the opposite direction lowers the lever.

The plate 42 and the hollow lugs 38 are left in the illustrated positions on the bicycle and with the stand detached the bicycle can be used in the normal manner. The bicycle is attached to the stand by sliding the plates 24 and 42 into engagement with each other. The bent over formations 44 prevent the plates from being moved directly apart from one another. Thereafter the struts 20 and 22 are pivoted towards the bicycle and the inclination of the rods 16 and 18 is adjusted so that their ends can be inserted into the hollow lugs 38. The bicycle is then supported by the stand in a stable manner with the rear wheel raised off the ground. The restraining plate 34 is raised and dropped into a fork 48 of the bicycle frame 10 whereafter the adjustment knob 46 is rotated to raise the lever and support member and bring the roller 30 into frictional engagement with the rear wheel 50 of the bicycle. The support member 28 may be raised or lowered in this manner to increase or decrease the resistance offered by the roller to the wheel. It will be noted that the bicycle can be converted into a stationary exercising apparatus without the use of any tools.

The roller offers frictional resistance to rotation of the rear wheel and thus the bicycle can be used, while stationary, as an exercising apparatus. The degree of resistance offered by the roller to rotation of the wheel can be adjusted as mentioned above. After use the stand is very simply detached from the bicycle and the bicycle may then be used in the normal manner without hindrance.

The stand, plate and hollow lugs may be made of a suitable metal such as steel.

I claim:

1. Exercising apparatus comprising a bicycle stably supported on a stand on a surface so that the rear wheel of the bicycle is free of the surface, the stand comprising a surface-engaging base, a first pair of members, one end of which is fixed to the base to form a fixed structure and the other end of which detachably engages with a pair of formations secured to the rear axle of the bicycle, a second pair of members each of which is pivotally connected at one end to the fixed structure and the other end being pivotally secured to a plate which detachably engages another plate secured to the frame of the bicycle in the region of the pedals, the said one plate having upstanding formations adapted to receive the edge of the other plate detachably to hold the two plates together, and a roller adapted to be brought into frictional engagement with the rear wheel of the bicycle.

2. Apparatus according to claim 1 wherein the one plate is adapted to be engaged or disengaged from the other plate by sliding one plate over the other.

3. Apparatus according to claim 2 wherein the upstanding formations are located on the plate which is pivotally connected to the second pair of members.

* * * * *